US011342641B2

(12) United States Patent
Hu et al.

(10) Patent No.: US 11,342,641 B2
(45) Date of Patent: May 24, 2022

(54) LIQUID CRYSTAL PHASE SHIFTING DEVICE INCLUDING PROTRUSIONS FORMED THEREIN, A MANUFACTURING METHOD THEREOF, AND A PHASE SHIFTER MATRIX FORMED BY THE PHASE SHIFTING DEVICES

(71) Applicant: Chengdu Tianma Micro-Electronics Co., Ltd., Chengdu (CN)

(72) Inventors: Yingru Hu, Chengdu (CN); Bo Wu, Chengdu (CN); Xuhui Peng, Shanghai (CN)

(73) Assignee: CHENGDU TIANMA MICRO-ELECTRONICS CO., LTD., Chengdu (CN)

( * ) Notice: Subject to any disclaimer, the term of this patent is extended or adjusted under 35 U.S.C. 154(b) by 0 days.

(21) Appl. No.: 16/958,745

(22) PCT Filed: May 22, 2019

(86) PCT No.: PCT/CN2019/087897

§ 371 (c)(1),
(2) Date: Jun. 29, 2020

(87) PCT Pub. No.: WO2020/015452

PCT Pub. Date: Jan. 23, 2020

(65) Prior Publication Data

US 2021/0367314 A1 Nov. 25, 2021

(30) Foreign Application Priority Data

Jul. 20, 2018 (CN) ..... 201810803275.7

(51) Int. Cl.

| | |
|---|---|
| ***H01P 1/18*** | (2006.01) |
| ***H01Q 3/36*** | (2006.01) |
| ***H01P 9/00*** | (2006.01) |

(52) U.S. Cl.
CPC ..... *H01P 1/181* (2013.01); *H01P 1/18* (2013.01); *H01P 1/184* (2013.01); *H01P 9/006* (2013.01); *H01Q 3/36* (2013.01)

(58) Field of Classification Search
CPC .. H01P 1/181; H01P 1/184; H01P 1/18; H01P 9/00; H01P 9/006; H01Q 3/36
(Continued)

(56) References Cited

U.S. PATENT DOCUMENTS

| | | | | |
|---|---|---|---|---|
| 10,629,973 | B2 * | 4/2020 | Jakoby et al. | H01P 1/184 |
| 2002/0179321 | A1 * | 12/2002 | Moller | H01P 1/184 174/255 |

(Continued)

FOREIGN PATENT DOCUMENTS

| | | | |
|---|---|---|---|
| CN | 105308789 | A | 2/2016 |
| CN | 106773338 | A | 5/2017 |

(Continued)

*Primary Examiner* — Benny T Lee
(74) *Attorney, Agent, or Firm* — Kilpatrick Townsend & Stockton, LLP

(57) ABSTRACT

Provided is a liquid crystal phase shifting device including: a first substrate and a second substrate that are opposite to each other, wherein first protrusions is provided on a surface of the first substrate facing towards the second substrate, second protrusions is provided on a surface of the second substrate facing towards the first substrate, and the first protrusions and the second protrusions are alternately arranged; a microstrip line provided on the surface of the first substrate facing towards the second substrate, the microstrip line covering at least part of the first protrusions; first support pads provided between the first substrate and the second substrate; a ground electrode provided on the surface of the second substrate facing towards the first substrate, the ground electrode overlapping at least part of
(Continued)

the second protrusions; and liquid crystal molecules provided between the microstrip line and the ground electrode.

20 Claims, 9 Drawing Sheets

(58) Field of Classification Search
USPC ..... 333/156, 161
See application file for complete search history.

(56) References Cited

U.S. PATENT DOCUMENTS

| | | | |
|---|---|---|---|
| 2014/0077894 | A1 | 3/2014 | Bulja |
| 2016/0164155 | A1 | 6/2016 | Wang et al. |

FOREIGN PATENT DOCUMENTS

| | | | |
|---|---|---|---|
| CN | 106953156 | A | 7/2017 |
| CN | 107004936 | A | 8/2017 |
| CN | 107453013 | A | 12/2017 |
| CN | 107994302 | A | 5/2018 |
| CN | 108196405 | A | 6/2018 |
| CN | 108710232 | A | 10/2018 |
| JP | 11103201 | A | 4/1999 |
| JP | 2004104382 | A | 4/2004 |

* cited by examiner

LIQUID CRYSTAL PHASE SHIFTING DEVICE INCLUDING PROTRUSIONS FORMED THEREIN, A MANUFACTURING METHOD THEREOF, AND A PHASE SHIFTER MATRIX FORMED BY THE PHASE SHIFTING DEVICES

CROSS-REFERENCE TO RELATED APPLICATIONS

The present disclosure is a U.S. National Stage of International Application No. PCT/CN2019/087897, filed on May 22, 2019, which claims priority to Chinese Patent Application No. 201810803275.7, filed on Jul. 20, 2018 and titled "LIQUID CRYSTAL PHASE SHIFTING DEVICE, MANUFACTURING METHOD THEREFOR, LIQUID CRYSTAL PHASE SHIFTER, AND ANTENNA", the contents of which are incorporated herein by reference in its entirety.

FIELD

The present disclosure relates to the technical field of phase shifting, and in particular, to a liquid crystal phase shifting device, a manufacturing method therefor, a liquid crystal phase shifter, and an antenna.

BACKGROUND

As a device for adjusting a phase of a wave, a phase shifter has been widely applied in areas such as radar, missile attitude control, accelerator, communications, instrumentation, and even music. The currently widely used phase shifter is a liquid crystal phase shifter.

The liquid crystal phase shifter includes a plurality of liquid crystal phase shifting devices. FIG. 1 is a schematic diagram of a structure of a liquid crystal phase shifting device in the related art. As shown in FIG. 1, the liquid crystal phase shifting device includes a first substrate 1' and a second substrate 2' that are opposite to each other. The first substrate 1' includes a microstrip line slot 3' in which a microstrip line is to be arranged, and the second substrate 2' includes a liquid crystal slot 4' in which liquid crystal molecules are to be provided.

In order to increase an amount of phase shifting of a microwave signal, the microstrip line needs to be set as long as possible. However, based on a structure of the existing liquid crystal phase shifting device, if the length of the microstrip line is increased, a volume of the liquid crystal phase shifting device will be increased. As a result, the liquid crystal phase shifting device will occupy more space. Therefore, there is a technical problem in the related art on how to increase the length of the microstrip line within a limited volume.

SUMMARY OF THE INVENTION

In view of the above described technical problem, embodiments of the present disclosure provide a liquid crystal phase shifting device and a manufacturing method therefor, a liquid crystal phase shifter, and an antenna, aiming to increase the length of the microstrip line without increasing the volume of the liquid crystal phase shifting device.

In an aspect, an embodiment of the present disclosure provides a liquid crystal phase shifting device, including: a first substrate and a second substrate that are opposite to each other, wherein a plurality of first protrusions is provided on a surface of the first substrate facing towards the second substrate, a plurality of second protrusions is provided on a surface of the second substrate facing towards the first substrate, and the plurality of first protrusions and the plurality of second protrusions are alternately arranged; a microstrip line provided on the surface of the first substrate facing towards the second substrate, the microstrip line covering at least part of the plurality of first protrusions; first support pads provided between the first substrate and the second substrate; a ground electrode provided on the surface of the second substrate facing towards the first substrate, the ground electrode overlapping at least part of the plurality of second protrusions; and liquid crystal molecules provided between the microstrip line and the ground electrode.

In another aspect, an embodiment of the present disclosure provides a manufacturing method for a liquid crystal phase shifting device, the manufacturing method is applied to the liquid crystal phase shifting device described above and includes: forming the first substrate having a surface provided with the plurality of first protrusions, and forming the second substrate having a surface provided with the plurality of second protrusions; forming the microstrip line on the first substrate in such a manner that the microstrip line covers at least part of the plurality of first protrusions, and forming the ground electrode on the second substrate in such a manner that the ground electrode overlaps at least part of the plurality of second protrusions; forming the first support pads on the first substrate; and aligning the first substrate with the second substrate, and providing the liquid crystal molecules between the microstrip line and the ground electrode.

In still another aspect, an embodiment of the present disclosure provides a liquid crystal phase shifter including a plurality of liquid crystal phase shifting devices described above, and the plurality of liquid crystal phase shifting devices is arranged in a matrix.

In yet another aspect, an embodiment of the present disclosure provides an antenna including the liquid crystal phase shifter described above.

One of the technical solutions described above has following beneficial effects.

In the technical solution according to the embodiments of the present disclosure, the first protrusions are provided on the first substrate, the second protrusions are provided on the second substrate, the microstrip line covers the first protrusions, and the ground electrode overlaps the second protrusions. Each of the microstrip line and the ground electrode is formed into a three-dimensional structure, and a directly-facing region is formed between a part of the microstrip line covering the side surface of each first protrusion and a part of the ground electrode overlapping the side surface of each second protrusion, forming the oblique electric field. It can be seen that, compared with the related art in which the microstrip line is formed into a planar structure, the microstrip line is formed into a three-dimensional structure according to the embodiments of the present disclosure can have an increased length within a unit volume. In other words, compared with the related art, in a case of a predetermined length of the microstrip line, the volume of the liquid crystal phase shifting device according to the embodiments of the present disclosure can be smaller, thereby decreasing the occupied space.

BRIEF DESCRIPTION OF THE DRAWINGS

In order to illustrate technical solutions of embodiments of the present disclosure, the accompanying drawings used in the embodiments or the prior art are introduced hereinafter. These drawings illustrate some embodiments of the present disclosure.

DETAILED DESCRIPTION OF THE EMBODIMENTS

In order to better understand technical solutions of the present disclosure, the embodiments of the present disclosure will be described in details with reference to the drawings last line therein, where like features are denoted by the same reference numbers throughout the detail description of the embodiments.

The terms used in the embodiments of the present disclosure are merely for the purpose of describing specific embodiments, rather than limiting the present disclosure. The singular form "a", "an", "the" and "said" used in the embodiments and claims shall be interpreted as also including the plural form, unless indicated otherwise in the context.

It should be understood that, the term "and/or" is used in the present disclosure merely to describe relations between associated objects, and thus includes three types of relations. That is, A and/or B can represent: A exists alone; A and B exist at the same time; or B exists alone. In addition, the character "/" generally indicates "or".

It is to be noted that, while support pads may be described using terms such as "first", "second" and "third" in the embodiments of the present disclosure, these support pads are not limited by these terms which are used for distinguishing the support pads from one another only. For example, a first support pad may be referred to as a support pad, without departing from the scope of the embodiments of the present disclosure. Likewise, a second support pad may be referred to as a first support pad.

Figure 2:
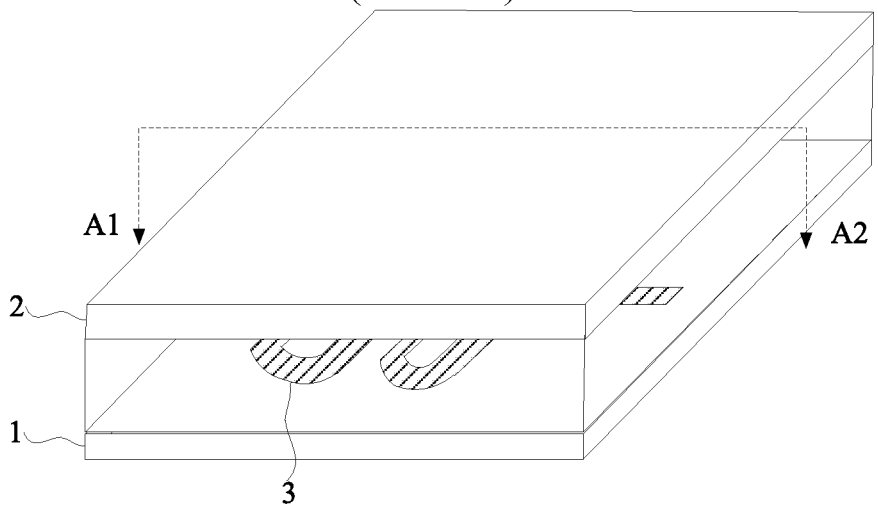
FIG. 2 is a top view of a liquid crystal phase shifting device according to an embodiment of the present disclosure.
Figure 3:
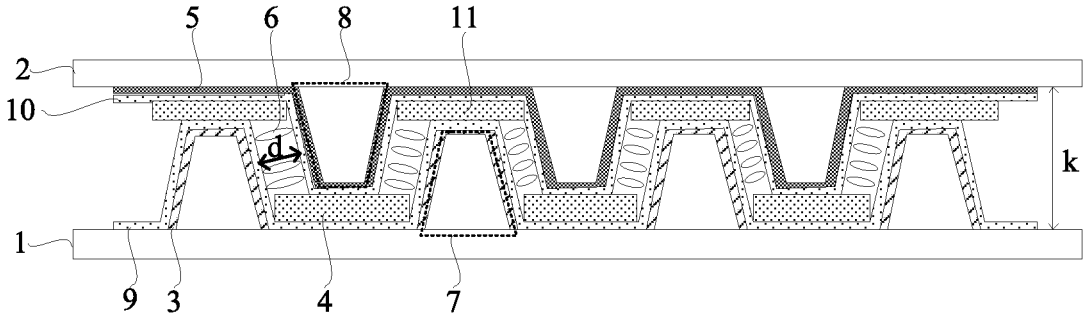
FIG. 3 is a cross-sectional view along line A1-A2 shown in FIG. 2.

The embodiments of the present disclosure provide a liquid crystal phase shifting device. FIG. 2 is a top view of a liquid crystal phase shifting device according to an embodiment of the present disclosure, and FIG. 3 is a cross-sectional view along line A1-A2 shown in FIG. 2. As shown in FIG. 3, the liquid crystal phase shifting device includes a first substrate 1 and a second substrate 2 that are opposite to each other, a microstrip line 3, first support pads 4, a ground electrode 5, and liquid crystal molecules 6.

As shown in FIG. 3, a plurality of first protrusions 7 is provided on a surface of the first substrate 1 facing towards the second substrate 2, and a plurality of second protrusions 8 is provided on a surface of the second substrate 2 facing towards the first substrate 1. The first protrusions 7 and the second protrusions 8 are alternately arranged. The microstrip line 3 is provided on the surface of the first substrate 1 facing towards the second substrate 2, and the microstrip line 3 covers at least part of the first protrusions 7. The first support pads 4 are arranged between the first substrate 1 and the second substrate 2. The ground electrode 5 is provided on the surface of the second substrate 2 facing towards the first substrate 1, and the ground electrode 5 overlaps at least part of the second protrusions 8. The liquid crystal molecules 6 are provided between the microstrip line 3 and the ground electrode 5. It can be understood that, in order to achieve alignment of the liquid crystal molecules 6, a first alignment layer 9 is further provided at a side of the microstrip line 3 facing away from the first substrate 1, and a second alignment layer 10 is provided at a side of the ground electrode 5 facing away from the second substrate 2.

When the liquid crystal phase shifting device is not in operation, there is no voltage applied in the microstrip line 3 and the ground electrode 5, and the liquid crystal molecules 6 are arranged in a preset direction under an action of the first alignment layer 9 and the second alignment layer 10. When the liquid crystal phase shifting device is in operation, a certain voltage signal is applied to the microstrip line 3 and a certain voltage signal is applied to the ground electrode 5, so that an electric field is formed between the microstrip line 3 and the ground electrode 5, and the liquid crystal molecules 6 are deflected under an action of the electric field. Meanwhile, a microwave signal is transmitted on the microstrip line 3. During transmission of the microwave signal, a phase of the microwave signal is changed due to deflection of the liquid crystal molecules 6. In this way, phase shifting of the microwave signal can be achieved. By controlling the voltage in the microstrip line 3 and the voltage in the ground electrode 5, a deflection angle of the liquid crystal molecules 6 can be controlled, and thus the phase adjusted during the phase shifting process can be controlled. After the phase shifting of the microwave signal is completed, the microwave signal, whose phase has been shifted, is transmitted from the liquid crystal phase shifting device via the microstrip line 3.

Figure 1:
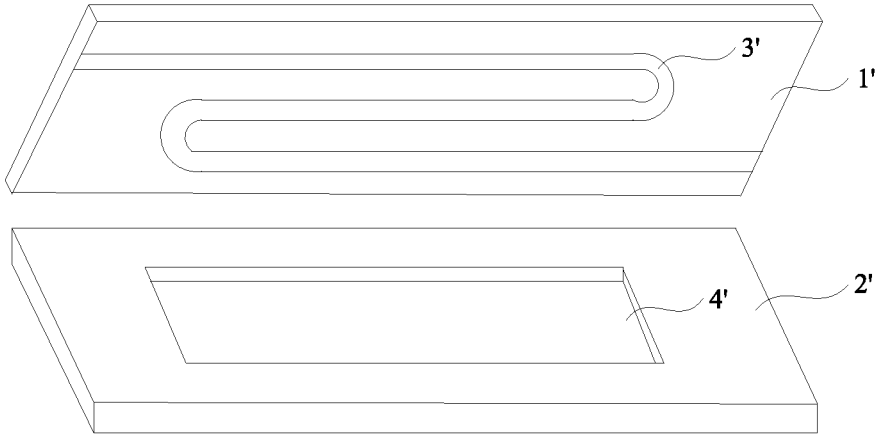
FIG. 1 (Prior Art)
FIG. 1 is a schematic diagram of a structure of a liquid crystal phase shifting device in the related art.

For the liquid crystal phase shifting device according to this embodiment of the present disclosure, the first substrate 1 is provided with the first protrusions 7 and the second substrate 2 is provided with the second protrusions 8, and the microstrip line 3 covers the first protrusions 7 and the ground electrode 5 overlaps the second protrusions 8. In this case, both the microstrip line 3 and the ground electrode 5 can be formed as a three-dimensional structure, and a part of the microstrip line 3 covering a side surface of the first protrusion 7 directly faces a part of the ground electrode 5 overlapping a side surface of the second protrusion 8, forming an oblique electric field. It can be seen that, compared with the related art as shown in FIG. 1 in which the microstrip line is formed into a planar structure, the microstrip line 3 formed into a three-dimensional structure in this embodiment of the present disclosure can have an increased length within a unit volume. In other words, compared with the related art, in a case of a predetermined length of the microstrip line 3, the liquid crystal phase shifting device in this embodiment of the present disclosure can have a smaller volume, decreasing the occupied space.

Figure 4:
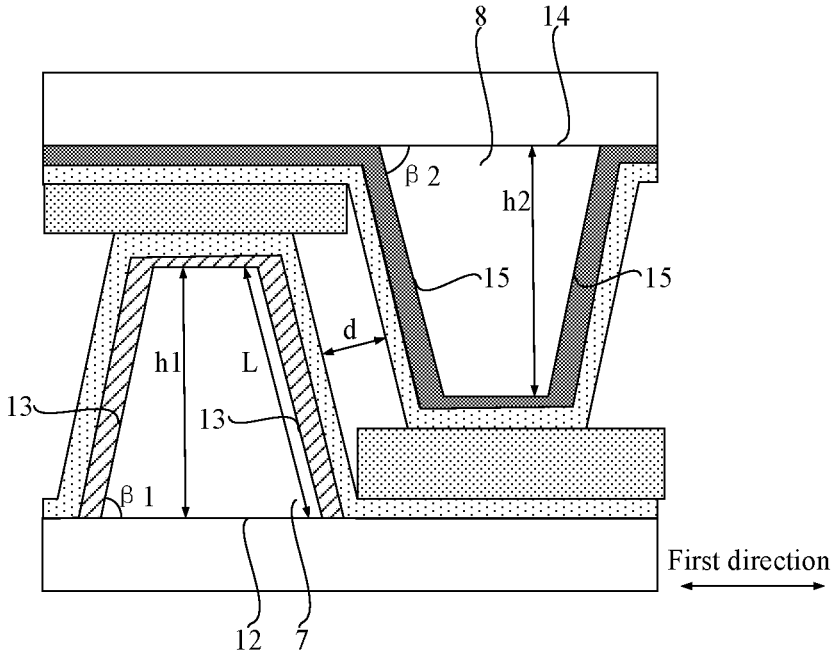
FIG. 4 is a schematic structural diagram showing a first protrusion and a second protrusion according to an embodiment of the present disclosure.

In addition, in the related art, since both the microstrip line and the ground electrode are formed into a planar structure, a thickness of a liquid crystal layer arranged between the microstrip line and the ground electrode is close to a distance between the first substrate and the second substrate. As a result, the thickness of the liquid crystal layer is relatively large. In this case, the alignment layer may apply different anchoring forces to the liquid crystal molecules at different regions of the liquid crystal layer, decreasing an accuracy of the phase shifting of the microwave signal by the liquid crystal molecules. In this embodiment of the present disclosure, on one hand, based on the three-dimensional structure of the microstrip line 3 and the ground electrode 5, a directly-facing region is formed between the microstrip line 3 and the ground electrode 5. With further reference to FIG. 3 and FIG. 4, the thickness of the liquid crystal layer at the directly-facing region is d, which is much smaller than a perpendicular distance k (FIG. 3) between the first substrate 1 and the second substrate 2. On the other hand, compared with the related art, in a case of a predetermined length of the microstrip line 3, the liquid crystal phase shifting device according to this embodiment of the present disclosure has a smaller volume, and accordingly, the thickness of the liquid crystal layer of the liquid crystal phase shifting device is smaller. Consequently, compared with the related art, for the liquid crystal phase shifting device according to this embodiment of the present disclosure, the thickness of the liquid crystal layer can be greatly decreased. In this way, an anchoring force applied to the liquid crystal molecules 6 at each region of the liquid crystal layer by the first alignment layer 9 and the second alignment layer 10 can be greatly increased, thereby improving the accuracy of the phase shifting of the microwave signal by the liquid crystal molecules 6.

In addition, in this embodiment of the present disclosure, the liquid crystal molecules 6 are provided between the side surface of the first protrusion 7 and the side surface of the second protrusion 8, and the thickness of the liquid crystal layer is relatively small. Therefore, compared with the related art in which the liquid crystal layer has a large thickness, a difference in thicknesses at different regions of the liquid crystal layer may be decreased in this embodiment of the present disclosure. Moreover, with the liquid crystal phase shifting device according to this embodiment of the present disclosure, there is no need to provide a liquid crystal slot, and it is not needed to fix the first substrate and the second substrate by screwing. This can avoid a problem of the poor thickness uniformity of the liquid crystal layer caused by process errors and screwing.

In an example, with further reference to FIG. 3, the first support pad 4 may be provided in a region of the surface of the first substrate 1 facing towards the second substrate 2 that is opposite to a respective second protrusion 8. The first support pad 4 is opposite to the second protrusion 8, so that the first support pad 4 can be used to ensure a certain distance between the side surfaces of the first protrusion 7 and the second protrusion 8 that are adjacent to each other, to form the thickness of the liquid crystal layer.

It should be noted that said "the first support pad 4 being located in the region of the surface of the first substrate 1 facing towards the second substrate 2 that is opposite to the second protrusion 8" means that a position of the first support pad 4 corresponds to a position of the second protrusion 8. That is, an orthographic projection of the first support pad 4 onto the second substrate 2 at least partially overlaps with an orthographic projection of the second protrusion 8 onto the second substrate 2.

In order to further improve support stability of the liquid crystal phase shifting device to achieve a more stable and uniform distance between the first substrate 1 and the second substrate 2, so that the liquid crystal can have a good thickness uniformity, with further reference to FIG. 3, the liquid crystal phase shifting device further includes second support pads 11, and the second support pad 11 is arranged in a region of the surface of the second substrate 2 facing towards the first substrate 1 that is opposite to a respective first protrusion 7.

In an example, one first support pad 4 can be provided between every two adjacent first protrusions 7, and one second support pad 11 can be arranged between every two adjacent second protrusions 8, further improving stable support for the liquid crystal phase shifting device. Moreover, in order to ensure that the first support pad 4 and the second support pad 11 do not interfere the signals transmitted on the microstrip line 3 and the ground electrode 5, the first support pad 4 and the second support pad 11 may be made of an insulation material, such as a resin material.

In addition, in order to make the liquid crystal molecules 6 be evenly and dispersedly distributed between the first substrate 1 and the second substrate 2, the plurality of first protrusions 7 is evenly distributed on the surface of the first substrate 1, and the plurality of second protrusions 8 is evenly distributed on the surface of the second substrate 2. In this way, the microstrip line 3 and the ground electrode 5, which have directly-facing regions, are evenly distributed between the first substrate 1 and the second substrate 2. This can achieve even distribution of the liquid crystal molecules 6, further improving stability of the phase shifting of the microwave signal by the liquid crystal molecule 6.

FIG. 4 is a schematic structural diagram showing a first protrusion and a second protrusion according to an embodiment of the present disclosure. As shown in FIG. 4, the first protrusion 7 includes a first bottom surface 12 and two first side surfaces 13. The first bottom surface 12 is a surface of the first protrusion 7 parallel to a plane of the first substrate 1 (FIG. 3) and close to the first substrate 1, and the first side surface 13 is a surface intersecting with the first bottom surface 12. An angle between the first side surface 13 and the first bottom surface 12 is β1, where 45°≤β1≤60°. The angle β1 is set within a range from 45° to 60° , so the angle between the first side surface 13 and the first bottom surface 12 is not too small or too large, such as close to 0° or 180° . In a case of a predetermined width L of the first side surface 13, if α1 is too small or too large, a space occupied by the first protrusion 7 in a first direction is too large. As a result, a number of first protrusions 7 that can be arranged in the first direction is small, decreasing a number of regions of the liquid crystal phase shifting device that can be filled with the liquid crystal molecules 6, and thus decreasing the accuracy of the phase shifting of the microwave signal by the liquid crystal molecules 6.

Correspondingly, the second protrusion 8 includes a second bottom surface 14 and two second side surfaces 15. The second bottom surface 14 is a surface of the second protrusion 8 parallel to a plane of the second substrate 2 and close to the second substrate 2, and the second side surface 15 is a surface intersecting with the second bottom surface 14. An angle between the second side surface 15 and the second bottom surface 14 is β2, where 45°≤β2≤60°. Similarly, the angle β2 is set within a range from 45° to 60°, so the angle between the second side surface 15 and the second bottom surface 14 is not too small or too large. In this case, a space occupied by the second protrusion 8 in the first direction is decreased, increasing a number of regions of the liquid crystal phase shifting device that can be filled with the liquid crystal molecules 6, and thus improving the accuracy of the phase shifting of the microwave signal by the liquid crystal molecules 6.

Further, β1 may be set equal to β2. In this case, the first side surface 13 of the first protrusion 7 is parallel to the second side surface 15 of the second protrusion 8, so that in the directly-facing region, a plane of the microstrip line 3 is equal to a plane of the ground electrode 5. That is, in the directly-facing region, the microstrip line 3 has, as shown in FIG. 3, a same distance to the ground electrode 5. In this case, in the directly-facing region, a difference in integrity of the electric field formed between the microstrip line 3 and the ground electrode 5 can be decreased, so that the liquid crystal molecules 6 in this region are deflected under an action of the electric field having a uniform intensity, and the accurate phase shifting of the microwave signal can be achieved.

In an example, with further reference to FIG. 4, for the first side surface 13 and the second side surface 15 that are opposite to each other in the first protrusion 7 and the second protrusion 8 that are adjacent to each other, a perpendicular distance between the microstrip line 3 covering the first side surface 13 and the ground electrode 5 overlapping the second side surface 15 is d, where 2 μm≤d≤10 μm. The minimum thickness of the liquid crystal layer is set to 2 μm, so the liquid crystal layer from is not too small, and thus this region can be filled with a sufficient number of liquid crystal molecules 6, to achieve the phase shifting of the microwave signal. The maximum thickness of the liquid crystal layer is set to 10 μm, so the thickness of the liquid crystal layer is not too large, and thus the first alignment layer 9 and the second alignment layer 10 can accurately align the liquid crystal molecules 6 at a middle position of this region, improving the accuracy of the phase shifting of the microwave signal by the liquid crystal molecules 6.

In an example, with further reference to FIG. 4, a height of the first protrusion 7 in a plane perpendicular to the first substrate 1 is h1, where 100 μm≤h1≤1000 μm, and a height of the second protrusion 8 in a plane perpendicular to the second substrate 2 is h2, where 100 μm≤h2≤1000 μm. The minimum values of h1 and h2 are set to 100 μm, so the first protrusion 7 and the second protrusion 8 are not too small. In this case, when the microstrip line 3 covers the first protrusion 7, within a unit volume, a length of the microstrip line 3 extending on the side surface of the first protrusion 7 is larger than a length of the microstrip line 3 extending in a plane in the related art. Therefore, the length of the microstrip line 3 can be effectively increased. The maximum values of h1 and h2 are set to 1000 μm, so the first protrusion 7 and the second protrusion 8 are not too large. This can prevent the thickness of the liquid crystal phase shifting device from being too large.

In order to simplify a manufacturing process and improve installation stability of the first protrusions 7 on the first substrate 1 (e.g. FIG. 3), the first protrusion 7 and the first substrate 1 may be formed into one piece, and the second protrusion 8 and the second substrate 2 (e.g. FIG. 3) may be formed into one piece.

Further, each of the first substrate 1 and the second substrate 2 may be a rigid substrate. For example, each of the first substrate 1 and the second substrate 2 is made of a glass material. In this case, each of the first substrate 1 and the second substrate 2 has a high rigidity. In a case where the first protrusion 7 and the first substrate 1 are formed into one piece, and the second protrusion 8 and the second substrate 2 are formed into one piece, the rigidity of the first protrusion 7 and the rigidity of the second protrusion 8 can be increased, avoiding deformation of the first protrusion 7 and the second protrusion 8. Therefore, the thickness uniformity of the liquid crystal layer can be further improved.

In an example, the first protrusion 7 and the second protrusion 8 may have various shapes, for example, a tapered structure, a cuboid structure or a trapezoidal structure. The shape of each of the first protrusion 7 and the second protrusion 8 can be designed according to actual needs, and will not be limited by the embodiments of the present disclosure.

Figure 5:
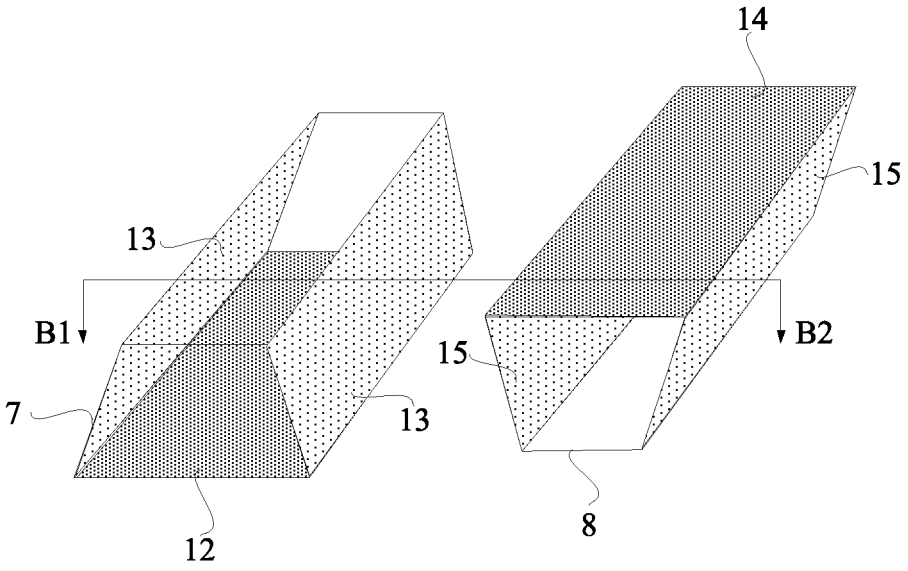
FIG. 5 is a schematic structural diagram showing a first protrusion and a second protrusion according to an embodiment of the present disclosure.
Figure 6:
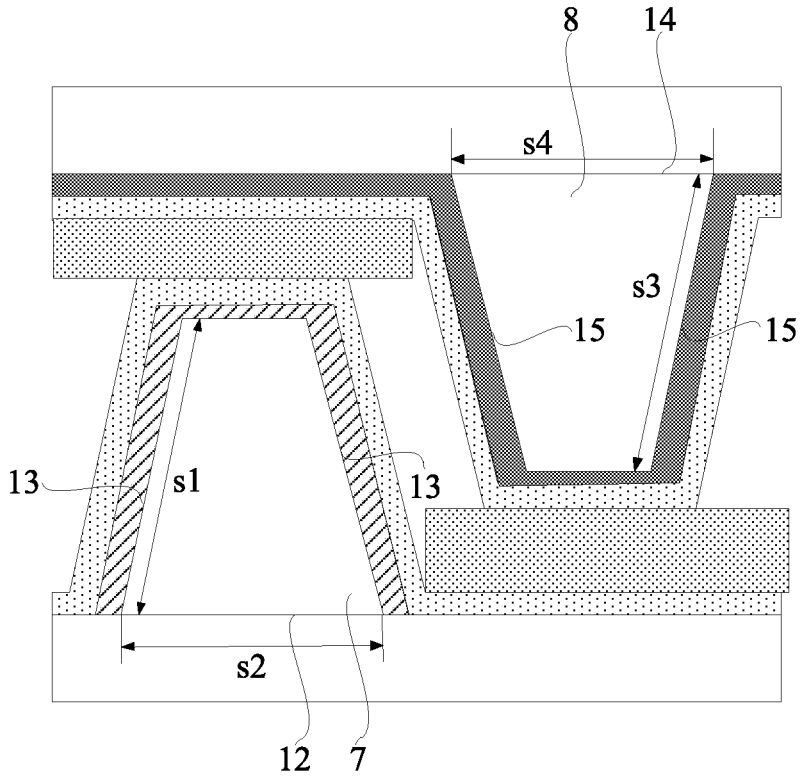
FIG. 6 is a cross-sectional view along line B1-B2 shown in FIG. 5.

FIG. 5 is a schematic structural diagram showing a first protrusion and a second protrusion according to an embodiment of the present disclosure, and FIG. 6 is a cross-sectional view along line B1-B2 shown in FIG. 5. In a case where each of the first protrusion 7 and the second protrusion 8 has a trapezoidal shape, as shown in FIGS. 5 and 6, the first protrusion 7 includes a first bottom surface 12 and two first side surfaces 13, and the second protrusion 8 includes a second bottom surface 14 and two second side surfaces 15. The microstrip line 3 covers the two first side surfaces 13, and the ground electrode 5 overlaps the two second side surfaces 15. Each of the first side surface 13 and the second side surface 15 has a trapezoidal shape. As shown in FIG. 6, a distance between an upper edge and a lower edge of the first side surface 13 is s1, a length of the first bottom surface 12 in a direction perpendicular to an extending direction of the first protrusion 7 is s2, a distance between an upper edge and a lower edge of the second side surface 15 is s3, and a length of the second bottom surface 14 in a direction perpendicular to an extending direction of the second protrusion 8 is s4, where 2 (s1+s3)>s2+s4.

When s1 to s4 are set to satisfy the relation described above, a length of the microstrip line 3 (FIG. 3) that forms a directly-facing region with the ground electrode 5 (FIG. 3), i.e., the length of the microstrip line extending on the first side surface 13 and the second side surface 15 is larger than a length of the microstrip line extending on the bottom surface 12 and the second bottom surface 14 in the related art. Therefore, within a unit volume, the length of the microstrip line 3 formed into a three-dimensional structure in this embodiment of the present disclosure is larger than the length of the microstrip line formed into a planar structure in the related art. Therefore, the length of the microstrip line 3 is increased.

Figure 7:
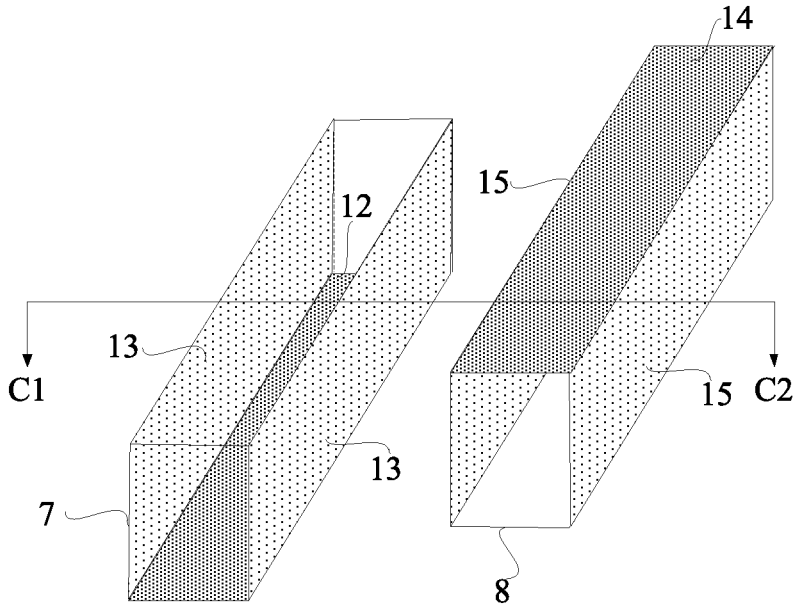
FIG. 7 is another schematic structural diagram showing a first protrusion and a second protrusion according to an embodiment of the present disclosure.
Figure 8:
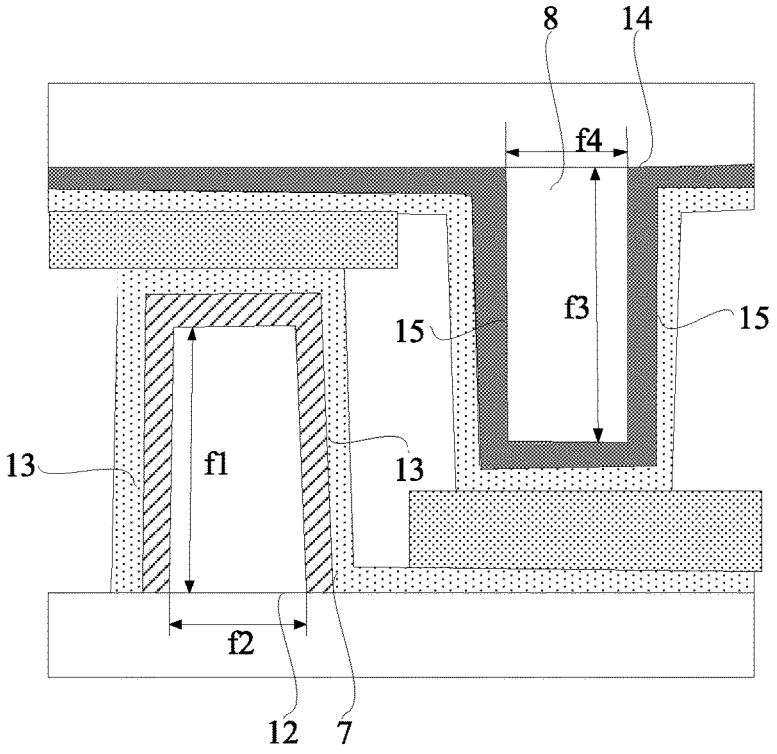
FIG. 8 is a cross-sectional view along line C1-C2 shown in FIG. 7.

FIG. 7 is another schematic structural diagram showing a first protrusion and a second protrusion according to an embodiment of the present disclosure, and FIG. 8 is a cross-sectional view along line C1-C2 shown in FIG. 7. In a case where each of the first protrusion 7 and the second protrusion 8 has a cuboid structure, as shown in FIG. 7 and FIG. 8, the first protrusion 7 includes a first bottom surface 12 and two first side surfaces 13, the second protrusion 8 includes a second bottom surface 14 and two second side surfaces 15, the microstrip line 3 (FIG. 3) covers the two first side surfaces 13, and the ground electrode 5 (FIG. 3) overlaps the two second side surfaces 15.

Each of the first side surface 13 and the second side surface 15 has a rectangular shape. As shown in FIG. 8, a width of the first side surface 13 is f1, a width of the first bottom surface 12 is f2, a width of the second side surface 15 is f3, and a width of the second bottom surface 14 is f4. In order to achieve that the length of the microstrip line 3 formed into a three-dimensional structure in this embodiment of the present disclosure is larger than the length of the microstrip line formed into a planar structure in the related art, f1 to f4 may satisfy 2(f1+f3)>f2+f4.

Figure 9:
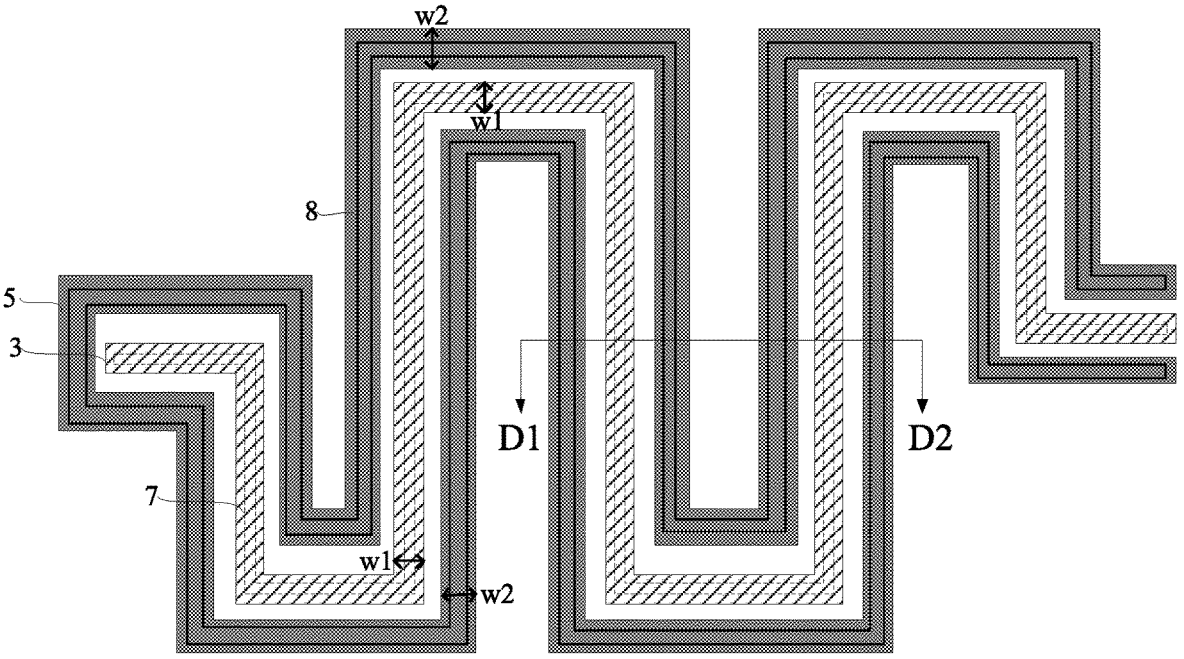
FIG. 9 is a top view showing a ground electrode and a microstrip line in a same pane according to an embodiment of the present disclosure.
Figure 10:
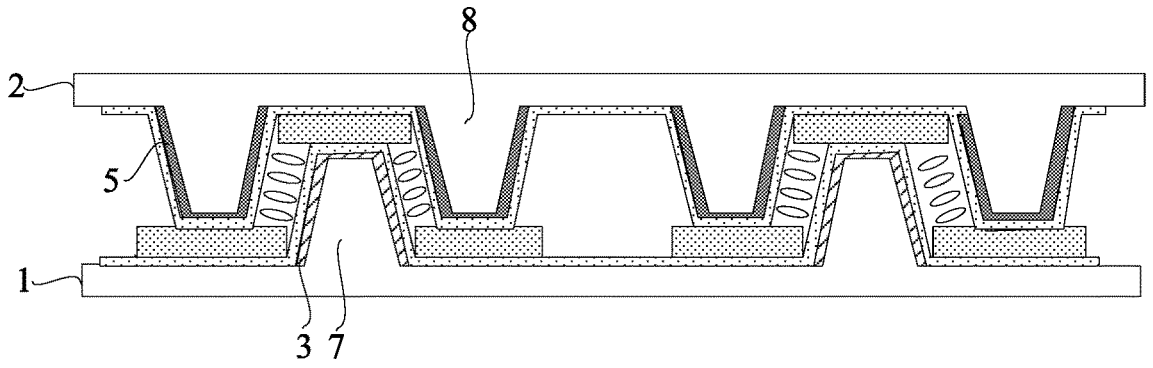
FIG. 10 is a cross-sectional view along line D1-D2 shown in FIG. 9.

FIG. 9 is a top view showing a ground electrode and a microstrip line in a same pane according to an embodiment of the present disclosure, and FIG. 10 is a cross-sectional view along line D1-D2 shown in FIG. 9. In an example, each of the microstrip line 3 and the ground electrode 5 may be a serpentine metal trace. In this case, the first protrusion 7 is of a continuous structure, and the extending direction of the first protrusion 7 is the same as an extending direction of the microstrip line 3. Moreover, the second protrusion 8 is of a continuous structure, and the extending direction of the second protrusion 8 is the same as an extending direction of the ground electrode 5.

Further, with further reference to FIG. 9, when a width of a trace segment of the ground electrode 5 in a direction perpendicular to the extending direction of the ground electrode 5 is w2, and a width of a trace segment of the microstrip line 3 in a direction perpendicular to the extending direction of the microstrip line 3 is w1, where w2>w1. The width of the ground electrode 5 is set to be larger, in such a manner that even if there is a deviation in a position of the ground electrode 5, the ground electrode 5 can still overlap an entire side surface of the second protrusion 8. Therefore, a directly-facing region between the microstrip line 3 and the ground electrode 5 is equal to a standard directly-facing region thereof, avoiding that the ground electrode 5 overlaps only a part of the side surface due to the deviation of the position of the ground electrode 5, which would otherwise lead to a decreased directly-facing region between the microstrip line 3 and the ground electrode 5.

It should be noted that the top view of the microstrip line 3 and the ground electrode 5 shown in FIG. 9 is merely a schematic top view of the microstrip line 3 and the ground electrode 5 in a same plane. Actually, the microstrip line 3 and the ground electrode 5 may be arranged on the first substrate 1 and at the second substrate 2, respectively, as shown in FIG. 10.

In order to further prevent a deviation between the ground electrode 5 and the microstrip line 3 due to process errors, which would otherwise adversely affect the phase shifting of the microwave signal, w1 and w2 may further satisfy that $$\frac{w2 - w1}{w1} \geq \frac{1}{10}.$$

Figure 11:
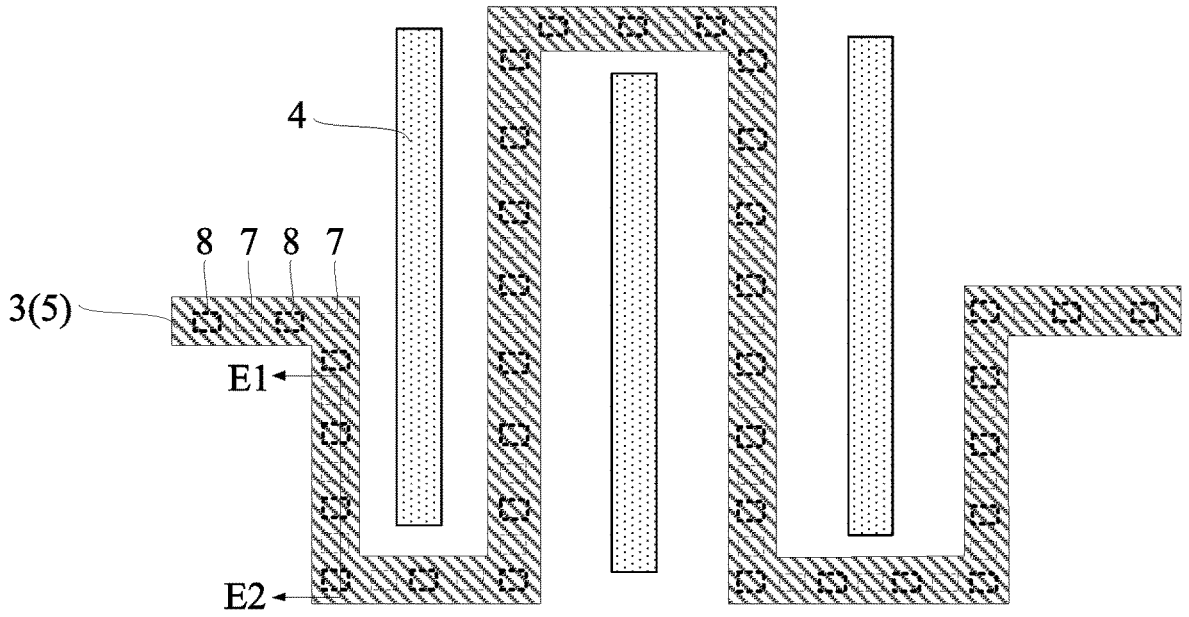
FIG. 11 is another top view showing a ground electrode and a microstrip line in a same plane according to an embodiment of the present disclosure.
Figure 12:
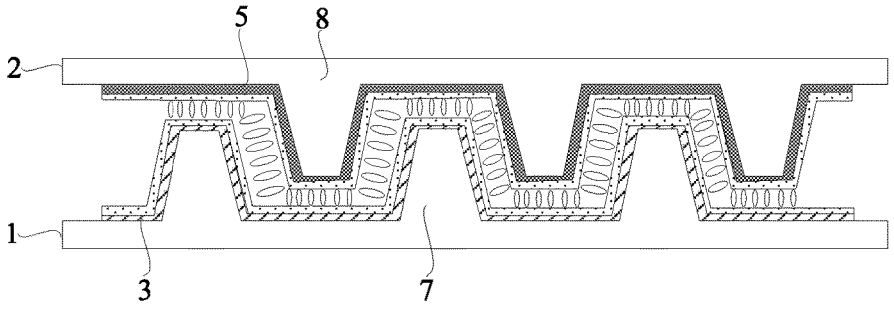
FIG. 12 is a cross-sectional view along line E1-E2 shown in FIG. 11.

FIG. 11 is another top view showing a ground electrode and a microstrip line in a same plane according to an embodiment of the present disclosure, and FIG. 12 is a cross-sectional view along line E1-E2 shown in FIG. 11. In an example, each of the microstrip line 3 and the ground electrode 5 is a serpentine metal trace as shown in FIG. 12, and an orthographic projection of the microstrip line 3 coincides with an orthographic projection of the ground electrode 5 in a same plane. Each of the first protrusion 7 and the second protrusion 8 may be a plurality of independent and dispersed structures. Moreover, the first protrusion 7 and the second protrusion 8 are alternately arranged in a trace segment of the microstrip line 3 and the ground electrode 5 that extends along a certain direction.

It should be noted that in the structure of the liquid crystal phase shifting device shown in FIG. 11, the first support pads 4 may be arranged in a peripheral region of the microstrip line 3 and the ground electrode 5, for example, in a U-shaped port defined by the microstrip line 3 and the ground electrode 5, to support the second substrate 2. Moreover, in order to further improve the support stability of the liquid crystal phase shifting device, so that the distance between the first substrate 1 and the second substrate 2 is more stable and uniform to achieve a uniform thickness of the liquid crystal, each U-shaped port defined by the microstrip line 3 and the ground electrode 5 may be provided with one first support pad 4.

Figure 13:
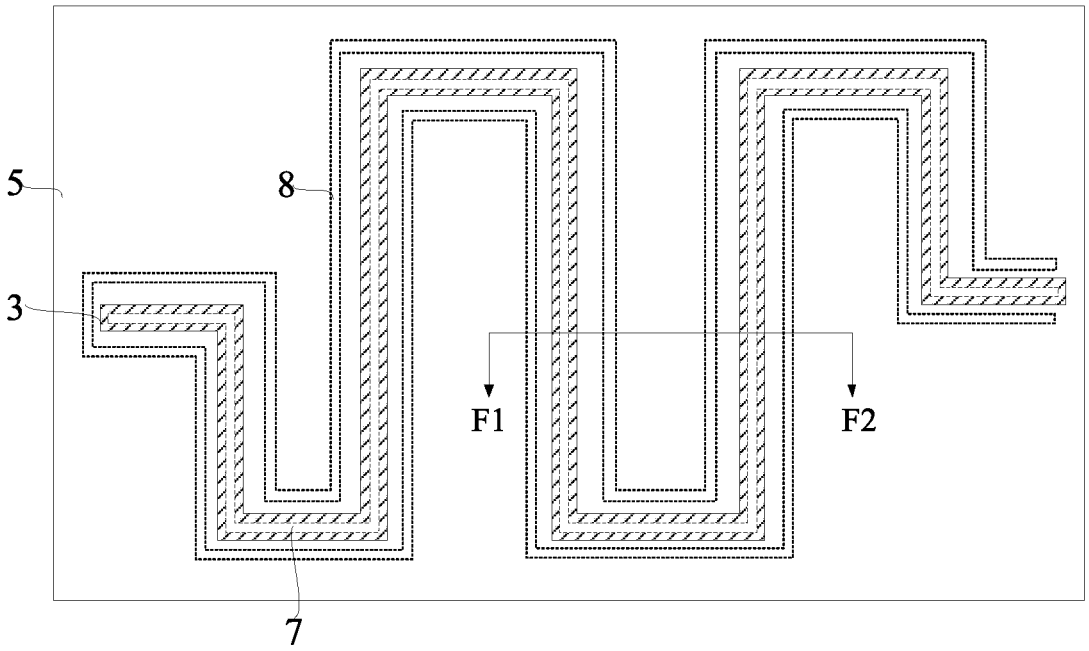
FIG. 13 is another top view showing a ground electrode and a microstrip line in a same plane according to an embodiment of the present disclosure.
Figure 14:
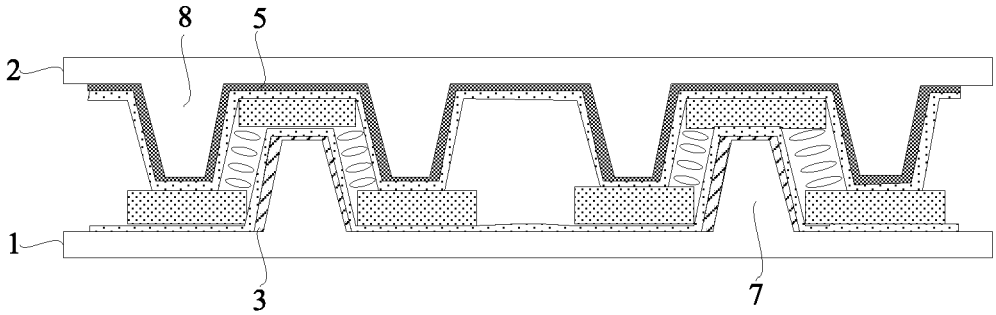
FIG. 14 is a cross-sectional view along line F1-F2 shown in FIG. 13.

FIG. 13 is another top view showing a ground electrode and a microstrip line in a same plane according to an embodiment of the present disclosure, and FIG. 14 is a cross-sectional view along line F1-F2 shown in FIG. 13. In an example, the microstrip line 3 is a serpentine metal trace, and the ground electrode 5 is a whole-surface metal film layer. In this case, the first protrusion 7 and the second protrusion 8 may be either a continuous structure as shown in FIG. 9, or independent and dispersed structures as shown in FIG. 11.

Figure 15:
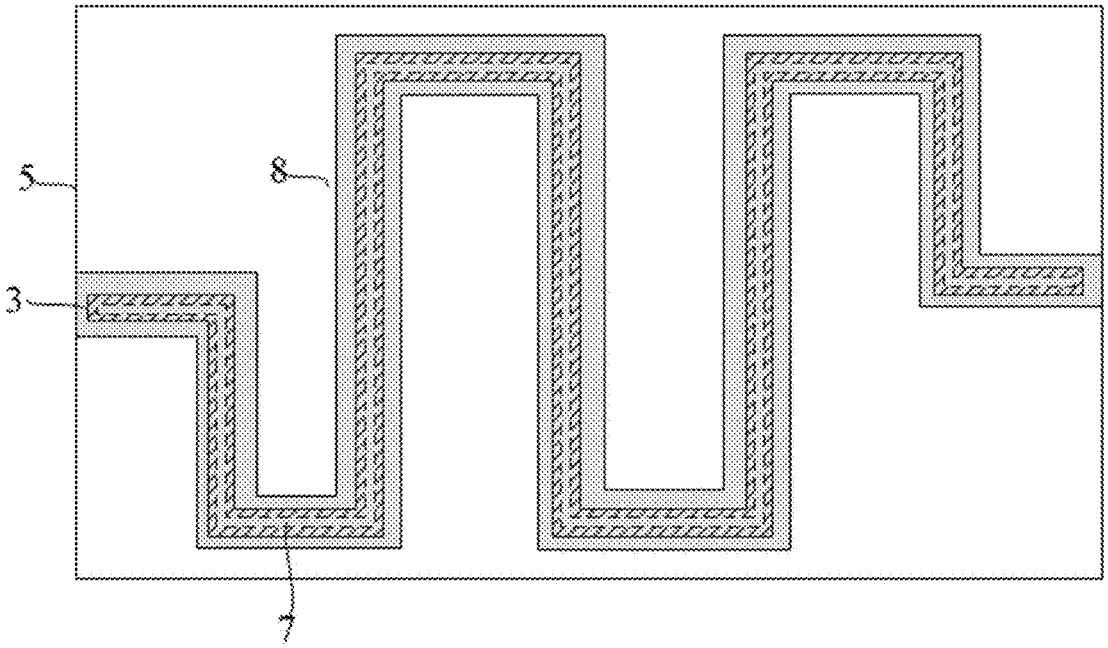
FIG. 15 is a schematic diagram of a structure of a ground electrode of a liquid crystal phase shifting device according to an embodiment of the present disclosure.

Further, in a case where the ground electrode 5 is a whole-surface metal film layer, only a part of the ground electrode 5 that overlaps the side surface of the second protrusion 8 forms an oblique electric field with the microstrip line 3. Therefore, in order to decrease the manufacturing costs and improve bendability of the ground electrode 5 for the better manufacturing of the flexible liquid crystal phase shifter, as shown in FIG. 15, which is a schematic diagram of a structure of a ground electrode of a liquid crystal phase shifting device according to an embodiment of the present disclosure, the ground electrode 5 includes a hollowed-out region. The hollowed-out region corresponds to a part of the ground electrode 5 that does not form an oblique electric field with the microstrip line 3, for example, corresponding to a part of the ground electrode 5 that is parallel to the plane of the second substrate 2 (FIG. 14). Further, in order to ensure continuity of signal transmission, the hollowed-out region of is the ground electrode 5 is a continuous region.

Figure 16:
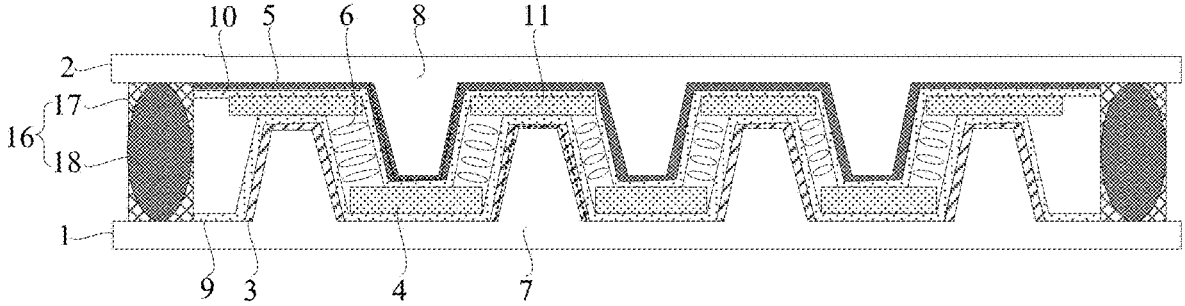
FIG. 16 is a schematic diagram of a structure of an encapsulation structure according to an embodiment of the present disclosure.

FIG. 16 is a schematic diagram of a structure of an encapsulation structure according to an embodiment of the present disclosure. In addition, as shown in FIG. 16, the liquid crystal phase shifting device further includes an encapsulation structure 16 for encapsulating the liquid crystal molecules 6. The encapsulation structure 16 includes a sealant 17 and spacers 18 distributed in the sealant 17.

In a manufacturing process for the encapsulation structure 16, the spacers 18 are first mixed in the sealant 17, then the first substrate 1 or the second substrate 2 is coated with the sealant 17 mixed with the spacers 18. Compared with the related art in which the spacers 18 are directly sprayed, for the encapsulation structure 16 according to this embodiment of the present disclosure, positions of the spacers 18 can be fixed by using the sealant 17, preventing the spacers 18 from contacting the microstrip line 3, which would otherwise cause interference or diffraction on the microwave signal. In this way, stability of transmission of the microwave signal can be improved, improving the accuracy of the phase shifting. Moreover, the sealant 17 may be made of a relatively soft material, so that an upper surface of the sealant 17 will be flush with upper surfaces of the spacers 18 during a coating process. Therefore, a height of the encapsulation structure 16 is limited by heights of the spacers 18. Each spacer 18 has a same dimension, so that no matter how many layers of spacers 18 are provided in the sealant 17 after coating, the encapsulation structure 16 has a same height at different positions, further improving uniformity of distances between first substrate 1 and the second substrate 2.

Figure 17:
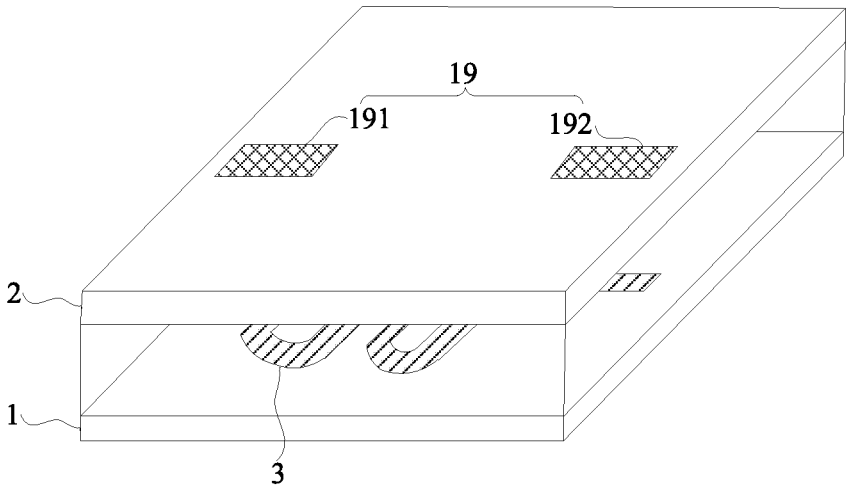
FIG. 17 is another schematic diagram of a structure of a liquid crystal phase shifting device according to an embodiment of the present disclosure.

FIG. 17 is another schematic diagram of a structure of a liquid crystal phase shifting device according to an embodiment of the present disclosure. In addition, it should be noted that, as shown in FIG. 17, the liquid crystal phase shifting device may further include a feeder line 19, which includes a feed-in trace segment 191 and a feed-out trace segment 192. The feed-in trace segment 191 is electrically connected to a microwave signal transmitting device (not shown), and the feed-out trace segment 192 is electrically connected to a microwave signal receiving device (not shown). In the phase shifting of the microwave signal, the feed-in trace segment 191 receives the microwave signal requiring for phase shifting, and then transmits the microwave signal to the microstrip line 3. After the phase shifting is completed, the feed-out trace segment 192 receives the microwave signal emitted from the microstrip line 3 and then transmits the microwave signal.

Figure 18:
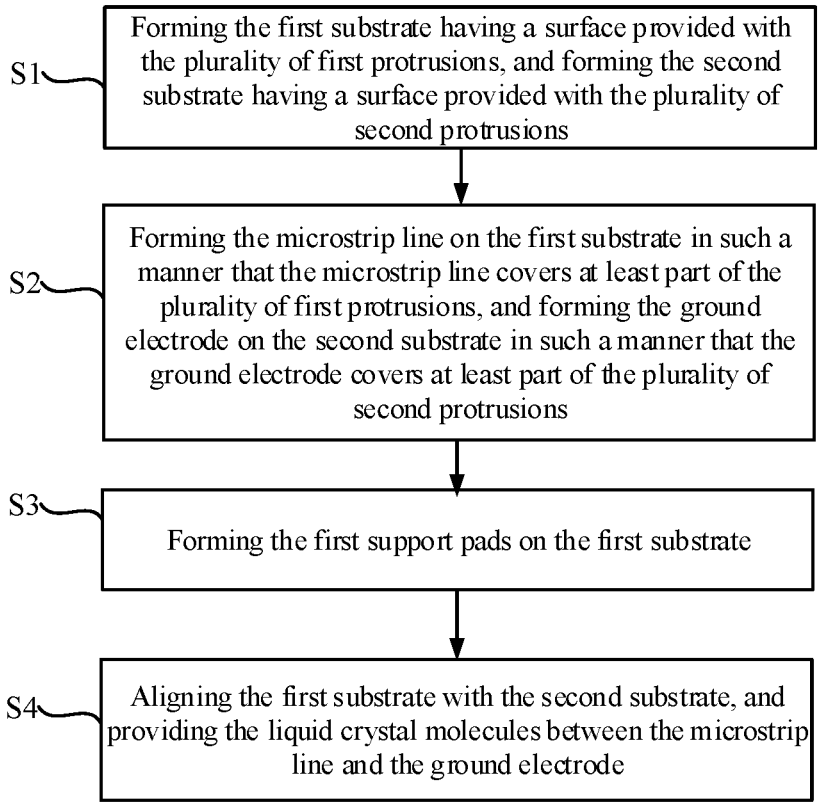
FIG. 18 is a flowchart of a manufacturing method for a liquid crystal phase shifting device according to an embodiment of the present disclosure.

The embodiments of the present disclosure further provide a manufacturing method for a liquid crystal phase shifting device, and the manufacturing method is applied to the liquid crystal phase shifting device described above. In combination with FIG. 2 and FIG. 3, as shown in FIG. 18, which is a flowchart of a manufacturing method for a liquid crystal phase shifting device according to an embodiment of the present disclosure, the manufacturing method includes following steps.

At step S1, the first substrate 1 having a surface provided with the plurality of first protrusions 7 (FIG. 3) is formed, and the second substrate 2 having a surface provided with the plurality of second protrusions 8 (FIG. 3) is formed. The plurality of first protrusions 7 and the plurality of second protrusions 8 may be formed separately, and then fixed to the first substrate 1 and the second substrate 2 by bonding or the like. Alternatively, the plurality of first protrusions 7 and the first substrate 1 may be formed into one piece and the plurality of second protrusions 8 and the second substrate 2 may be formed into one piece, or the plurality of first protrusions 7 and the plurality of second protrusions 8 are formed by depositing other material surfaces of the first substrate 1 and the second substrate 2 and then patterning.

At step S2, the microstrip line 3 is formed on the first substrate 1 in such a manner that the microstrip line 3 covers at least part of the plurality of first protrusions 7, and the ground electrode 5 (FIG. 3) is formed on the second substrate 2 in such a manner that the ground electrode 5 overlaps at least part of the plurality of second protrusions 8. In an example, the microstrip line 3 and the ground electrode 5 may be formed by magnetron sputtering, electroplating, etc.

At step S3, the first support pads 4 (FIG. 3) are formed on the first substrate 1 in such a manner that each of the first support pads 4 is located in a region of the first substrate 1 facing towards the second substrate 2 that is opposite to a respective second protrusion 8.

At step S4, the first substrate 1 is aligned with the second substrate 2, and the liquid crystal molecules 6 (FIG. 3) are provided between the microstrip line 3 and the ground electrode 5.

It should be noted that in a case where the liquid crystal molecules 6 are provided between the microstrip line 3 and the ground electrode 5 by pouring, it is needed to first align the first substrate 1 with the second substrate 2, and then the liquid crystal molecules 6 are provided between the first substrate 1 and the second substrate 2 by pouring. In a case where the liquid crystal molecules 6 are provided between the microstrip line 3 and the ground electrode 5 by drip-attaching, it is needed to first drip-attach the liquid crystal molecules 6 to the microstrip line 3, and then the second substrate 2 provided with the ground electrode 5 is aligned with the first substrate 1. At step S4, an order for "aligning the first substrate 1 with second substrate 2" and "providing the liquid crystal molecules 6 between the microstrip line 3 and the ground electrode 5" is not limited.

In the manufacturing method for the liquid crystal phase shifting device according to this embodiment of the present disclosure, the first protrusions 7 are provided on the first substrate 1, the second protrusions 8 are provided on the second substrate 2, the microstrip line 3 covers the first protrusions 7, and the ground electrode 5 overlaps the second protrusions 8. Each of the microstrip line 3 and the ground electrode 5 is formed into a three-dimensional structure, and a directly-facing region is formed between a part of the microstrip line 3 covering the side surface of the first protrusion 7 and a part of the ground electrode 5 overlapping the side surface of the second protrusion 8, forming an oblique electric field. It can be seen that, compared with the related art in which the microstrip line is formed into a planar structure, the microstrip line 3 formed into a three-dimensional structure in this embodiment of the present disclosure can have an increased length within a unit volume. In other words, compared with the related art, in a case of a determined length of the microstrip line 3, the liquid crystal phase shifting device manufactured with the manufacturing method according to the embodiments of the present disclosure can have the smaller volume, decreasing the occupied space.

In addition, the first support pad 4 is formed at a position opposite to the second protrusion 8, so that the first support pad 4 can be used to ensure a certain distance between the side surface of each first protrusion 7 and the side surface of the second protrusion 8 adjacent to the first protrusion 7, to form the thickness of the liquid crystal layer. In order to further improve support stability of the liquid crystal phase shifting device to achieve a more stable and uniform distance between the first substrate 1 and the second substrate 2, so that the liquid crystal can have a good thickness uniformity, the second support pads 11 are formed at in regions of the surface of the second substrate 2 facing towards the first substrate 1 that are opposite to the first protrusions 7.

In combination with FIG. 16, in a case where the liquid crystal phase shifting device further includes an encapsulation structure 16 and the encapsulation structure 16 includes a sealant 17 and spacers 18 distributed in the sealant 17, before aligning the first substrate 1 with the second substrate 2, the manufacturing method for the liquid crystal phase shifting device further includes: forming the sealant 17 mixed with the spacers 18 onto the first substrate 1 or the second substrate 2. In this manufacturing method, the positions of the spacers 18 can be fixed by using the sealant 17, preventing the spacers 18 from contacting the microstrip line 3, which would otherwise cause interference or diffraction on the microwave signal. In this way, stability of transmission of the microwave signal can be improved, and the encapsulation structure 16 can have a same height at different positions due to the spacers 18, further improving uniformity of distances between first substrate 1 and the second substrate 2.

It should be noted that in a case where the liquid crystal phase shifting device includes the first support pads 4, the second support pads 11, the first alignment layer 9 and the second alignment layer 10, the first alignment layer 9 and the second alignment layer 10 may be formed before or after the first support pads 4 and the second support pads 11 are formed, which will not be limited by the embodiments of the present disclosure.

In an example, each of the first alignment layer 9 and the second alignment layer 10 may be an optical alignment layer, which may be made of a material such as polyimide. In this case, an alignment manner in which the first alignment layer 9 and the second alignment layer 10 align the liquid crystal molecules 6 may be an optical alignment manner.

Figure 19:
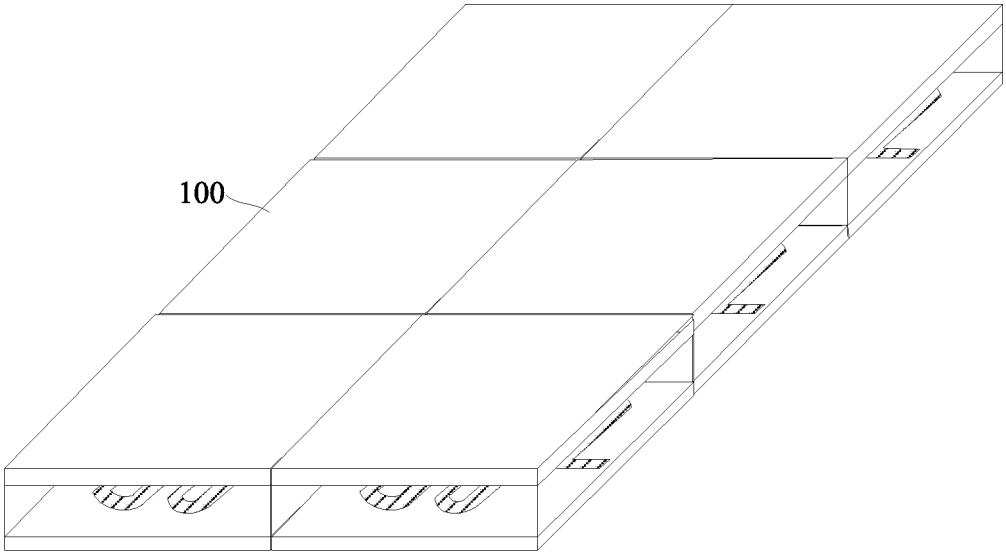
FIG. 19 is a schematic diagram of a structure of a liquid crystal phase shifter according to an embodiment of the present disclosure.

The embodiments of the present disclosure further provide a liquid crystal phase shifter. As shown in FIG. 19, which is a schematic diagram of a structure of a liquid crystal phase shifter according to an embodiment of the present disclosure, the liquid crystal phase shifter includes a plurality of liquid crystal phase shifting devices 100 that is arranged in a matrix.

Since the liquid crystal phase shifter according to this embodiment of the present disclosure includes the plurality of liquid crystal phase shifting devices 100 described above, with the liquid crystal phase shifter, an oblique electric field can be formed between the ground electrode and the microstrip line, and thus the thickness of the liquid crystal layer of the liquid crystal phase shifting device can be greatly decreased. In this way, an anchoring force applied to the liquid crystal molecules at each region of the liquid crystal layer by the alignment layer can be greatly increased, improving the accuracy of the phase shifting of the microwave signal by the liquid crystal molecules.

In an example, in order to simplify the manufacturing process and decrease complexity of the process, ground electrodes of multiple liquid crystal phase shifting devices can be formed into one piece.

The embodiments of the present disclosure further provide an antenna, which includes the liquid crystal phase shifter described above. Since the antenna according to this embodiment of the present disclosure includes the liquid crystal phase shifter described above, then the antenna can greatly decrease the thickness of the liquid crystal layer of the liquid crystal phase shifting device, improving the accuracy of the phase shifting of the microwave signal by the liquid crystal molecules.

What is claimed is:

1. A liquid crystal phase shifting device, comprising:

a first substrate and a second substrate that are opposite to each other, wherein a plurality of first protrusions are provided on a surface of the first substrate facing towards the second substrate, a plurality of second protrusions are provided on a surface of the second substrate facing towards the first substrate, and the plurality of first protrusions and the plurality of second protrusions are alternately arranged;

a microstrip line provided on the surface of the first substrate facing towards the second substrate, the microstrip line covering at least part of the plurality of first protrusions;

first support pads provided between the first substrate and the second substrate;

a ground electrode provided on the surface of the second substrate facing towards the first substrate, the ground electrode overlapping at least part of the plurality of second protrusions; and liquid crystal molecules provided between the microstrip line and the ground electrode.

2. The liquid crystal phase shifting device according to claim 1, wherein each of the first support pads is located in a region of the surface of the first substrate facing towards the second substrate, the region being opposite to a respective one of the plurality of second protrusions.

3. The liquid crystal phase shifting device according to claim 1, further comprising: second support pads, each of the second support pads is located in a region of the surface of the second substrate facing towards the first substrate, the region being opposite to a respective one of the plurality of first protrusions.

4. The liquid crystal phase shifting device according to claim 3, wherein a respective one of the first support pads is provided between every two adjacent first protrusions, and a respective one of the second support pads is provided between every two adjacent second protrusions.

5. The liquid crystal phase shifting device according to claim 3, wherein each of the first support pads and the second support pads is made of a resin material.

6. The liquid crystal phase shifting device according to claim 1, wherein the plurality of the first protrusions is evenly distributed on the surface of the first substrate, and the plurality of the second protrusions is evenly distributed on the surface of the second substrate.

7. The liquid crystal phase shifting device according to claim 1, wherein one of the plurality of first protrusions comprises a first bottom surface and two first side surfaces; the first bottom surface is a surface of a first protrusion parallel to a plane of the first substrate and close to the first substrate, each of the two first side surfaces is a surface intersecting with the first bottom surface at an angle, and the angle between one of the two first side surfaces and the first bottom surface is $\beta 1$, where $45° \leq \beta 1 \leq 60°$; and one of the plurality of second protrusions comprises a second bottom surface and two second side surfaces; the second bottom surface is a surface of a second protrusion that is parallel to a plane of the second substrate and close to the second substrate, each of the two second side surfaces is a surface intersecting with the second bottom surface at an angle, and the angle between one of the two second side surfaces and the second bottom surface is $\beta 2$, where $45° \leq \beta 2 \leq 60°$.

8. The liquid crystal phase shifting device according to claim 7, wherein $\beta 1=\beta 2$.

9. The liquid crystal phase shifting device according to claim 7, wherein for one of the two first side surfaces and one of the two second side surfaces that are opposite to each other in one of the plurality of first protrusions and one of the plurality of second protrusions that are adjacent to each other, a perpendicular distance between the microstrip line covering the one of the two first side surfaces and the ground electrode overlapping the one of the two second side surfaces is d, where $2\ \mu m \le d \le 10\ \mu m$.

10. The liquid crystal phase shifting device according to claim 1, wherein a height of one of the plurality of first protrusions in a plane perpendicular to the first substrate is h1, where $100\ \mu m \le h1 \le 1000\ \mu m$; and a height of one of the plurality of second protrusions in a plane perpendicular to the second substrate is h2, where $100\ \mu m \le h2 \le 1000\ \mu m$.

11. The liquid crystal phase shifting device according to claim 1, wherein the plurality of first protrusions and the first substrate are formed into one piece, and the plurality of second protrusions and the second substrate are formed into one piece.

12. The liquid crystal phase shifting device according to claim 1, wherein a region of the ground electrode that is parallel to a plane of the second substrate is hollowed out, and another region of the ground electrode that is not hollowed out is a continuous region.

13. The liquid crystal phase shifting device according to claim 1, wherein each of the plurality of first protrusions and the plurality of second protrusions is of a pyramidal structure, a cuboid structure or a trapezoidal structure.

14. The liquid crystal phase shifting device according to claim 13, wherein one of the plurality of first protrusions comprising a first bottom surface and two first side surfaces, and one of the plurality of second protrusions is of a trapezoidal structure comprising a second bottom surface and two second side surfaces; and each of the two first side surfaces and the two second side surfaces is of a trapezoidal shape, a distance between an upper edge and a lower edge of one of the two first side surfaces is s1, a length of the first bottom surface in a direction perpendicular to an extending direction of a first protrusion is s2, a distance between an upper edge and a lower edge of one of the two second side surfaces is s3, and a length of the second bottom surface in a direction perpendicular to an extending direction of a second protrusion is s4, where $2(s1+s3)>s2+s4$.

15. The liquid crystal phase shifting device according to claim 13, wherein one of the plurality of first protrusions is of a cuboid structure comprising a first bottom surface and two first side surfaces, and one of the plurality of second protrusions is of a cuboid structure comprising a second bottom surface and two second side surfaces; and each of the two first side surfaces and the two second side surfaces is of a rectangular shape, a width of one of the two first side surfaces is f1, a width of the first bottom surface is f2, a width of one of the two second side surfaces is f3, and a width of the second bottom surface is f4, where $2(f1+f3)>f2+f4$.

16. The liquid crystal phase shifting device according to claim 1, wherein each of the microstrip line and the ground electrode includes a respective serpentine metal trace, and a width of a trace segment of the microstrip line in a direction perpendicular to an extending direction of the microstrip line is w1, and a width of a trace segment of the ground electrode in a direction perpendicular to an extending direction of the ground electrode is w2, where $w2>w1$.

17. The liquid crystal phase shifting device according to claim 16, wherein $$\frac{w2-w1}{w1} \ge \frac{1}{10}.$$

18. A manufacturing method for a liquid crystal phase shifting device, wherein the manufacturing method is applied to a liquid crystal phase shifting device, wherein the liquid crystal phase shifting device comprises:

a first substrate and a second substrate that are opposite to each other, wherein a plurality of first protrusions are provided on a surface of the first substrate facing towards the second substrate, a plurality of second protrusions are provided on a surface of the second substrate facing towards the first substrate, and the plurality of first protrusions and the plurality of second protrusions are alternately arranged;

a microstrip line provided on the surface of the first substrate facing towards the second substrate, the microstrip line covering at least part of the plurality of first protrusions;

first support pads provided between the first substrate and the second substrate;

a ground electrode provided on the surface of the second substrate facing towards the first substrate, the ground electrode overlapping at least part of the plurality of second protrusions; and liquid crystal molecules provided between the microstrip line and the ground electrode, wherein the manufacturing method comprises:

forming the first substrate having a surface provided with the plurality of first protrusions, and forming the second substrate having a surface provided with the plurality of second protrusions;

forming the microstrip line on the first substrate in such a manner that the microstrip line covers at least part of the plurality of first protrusions, and forming the ground electrode on the second substrate in such a manner that the ground electrode overlaps at least part of the plurality of second protrusions;

forming the first support pads on the first substrate; and aligning the first substrate with the second substrate, and providing the liquid crystal molecules between the microstrip line and the ground electrode.

19. A liquid crystal phase shifter, comprising a plurality of liquid crystal phase shifting devices, wherein the plurality of liquid crystal phase shifting devices are arranged in a matrix, and wherein each of the plurality of liquid crystal phase shifting devices comprises:

a respective first substrate and a respective second substrate that are opposite to each other, wherein a plurality of respective first protrusions are provided on a surface of the respective first substrate facing towards the respective second substrate, a plurality of respective second protrusions are provided on a surface of the respective second substrate facing towards the respective first substrate, and the plurality of respective first protrusions and the plurality of respective second protrusions are alternately arranged;

a respective microstrip line provided on the surface of the respective first substrate facing towards the respective second substrate, the respective microstrip line covering at least part of the plurality of respective first protrusions;

respective first support pads provided between the respective first substrate and the respective second substrate;

a respective ground electrode provided on the surface of the respective second substrate facing towards the respective first substrate, the respective ground electrode overlapping at least part of the plurality of respective second protrusions; and respective liquid crystal molecules provided between the respective microstrip line and the respective ground electrode.

20. The liquid crystal phase shifter according to claim 19, wherein each of the respective ground electrodes of the plurality of liquid crystal phase shifting devices are formed into one piece.

* * * * *